US005364729A

United States Patent [19]

Kmiecik-Lawrynowicz et al.

[11] Patent Number: 5,364,729

[45] Date of Patent: Nov. 15, 1994

[54] TONER AGGREGATION PROCESSES

[75] Inventors: Grazyna E. Kmiecik-Lawrynowicz, Burlington; Raj D. Patel, Oakville; Michael A. Hopper, Toronto, all of Canada

[73] Assignee: Xerox Corporation, Stamford, Conn.

[21] Appl. No.: 82,660

[22] Filed: Jun. 25, 1993

[51] Int. Cl.[5] ..... G03G 9/08

[52] U.S. Cl. ..... 430/137; 523/322; 523/335; 523/339

[58] Field of Search ..... 430/137; 523/322, 335, 523/339

[56] References Cited

U.S. PATENT DOCUMENTS

| | | | |
|---|---|---|---|
| 4,137,188 | 1/1979 | Uetake et al. | 252/62.54 |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripaute et al. | 430/137 |

*Primary Examiner*—Roland Martin
*Attorney, Agent, or Firm*—E. O. Palazzo

[57] ABSTRACT

A process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin, to form electrostatically bound toner size aggregates with a narrow particle size distribution; and (iv) heating said bound aggregates above about the Tg of the resin.

48 Claims, No Drawings

TONER AGGREGATION PROCESSES

BACKGROUND OF THE INVENTION

The present invention is generally directed to toner processes, and more specifically to aggregation and coalescence processes for the preparation of toner compositions. In embodiments, the present invention is directed to the economical preparation of toners without the utilization of the known pulverization and/or classification methods, and wherein in embodiments toner compositions with an average volume diameter of from about 1 to about 25, and preferably from 1 to about 10 microns and narrow GSD of, for example, from about 1.16 to about 1.26 as measured on the Coulter Counter can be obtained. The resulting toners can be selected for known electrophotographic imaging, printing processes, including color processes, and lithography. In embodiments, the present invention is directed to a process comprised of dispersing a pigment and optionally toner additives like a charge control agent or additive in an aqueous mixture containing an ionic surfactant in amount of from about 0–5 percent (weight percent throughout unless otherwise indicated) to about 10 percent and shearing this mixture with a latex or emulsion mixture, comprised of suspended submicron resin particles of from, for example, about 0.01 micron to about 2 microns in volume average diameter in an aqueous solution containing a counterionic surfactant in amounts of from about 1° percent to about 10 percent with opposite charge to the ionic surfactant of the pigment dispersion, and nonionic surfactant in amounts of from about 0 percent to about 5 percent, thereby causing a flocculation of resin particles, pigment particles and optional charge control agent, followed by heating at about 5° to about 40° C. below the resin Tg and preferably about 5° to about 25° C. below the resin Tg while stirring of the flocculent mixture which is believed to form statically bound aggregates of from about 1 micron to about 10 microns in volume average diameter comprised of resin, pigment and optionally charge control particles, and thereafter heating the formed bound aggregates about above the Tg (glass transition temperature) of the resin. The size of the aforementioned statistically bonded aggregated particles can be controlled by adjusting the temperature in the below the resin Tg heating stage. An increase in the temperature causes an increase in the size of the aggregated particle. This process of aggregating submicron latex and pigment particles is kinetically controlled, that is the temperature increases the process of aggregation. The higher the temperature during stirring the quicker the aggregates are formed, for example from about 2 to about 10 times faster in embodiments, and the latex submicron particles are picked up more quickly. The temperature also controls in embodiments the particle size distribution of the aggregates, for example the higher the temperature the narrower the particle size distribution and this narrower distribution can be achieved in, for example, from about 0–5 to about 24 hours and preferably in about 1 to about 3 hours time. Heating the mixture about above or in embodiments equal to the resin Tg generates toner particles with, for example, an average particle volume diameter of from about 1 to about 25 and preferably 10 microns. It is believed that during the heating stage, the components of aggregated particles fuse together to form composite toner particles. In another embodiment thereof, the present invention is directed to an in situ process comprised of first dispersing a pigment, such as HELIOGEN BLUE TM or HOSTAPERM PINK TM, in an aqueous mixture containing a cationic surfactant such as benzalkonium chloride (SANIZOL B-50 TM), utilizing a high shearing device, such as a Brinkmann Polytron, microfluidizer or sonicator, thereafter shearing this mixture with a latex of suspended resin particles, such as poly(styrene butadiene acrylic acid), poly(styrene butylacrylate acrylic acid) or PLIOTONE TM a poly(styrene butadiene), and which particles are, for example, of a size ranging from about 0.01 to about 0.5 micron in volume average diameter as measured by the Brookhaven nanosizer in an aqueous surfactant mixture containing an anionic surfactant such as sodium dodecylbenzene sulfonate (for example NEOGEN R TM or NEOGEN SC TM) and a nonionic surfactant such as alkyl phenoxy poly(ethylenoxy)ethanol (for example IGEPAL 897 TM or ANTAROX 897 TM), thereby resulting in a flocculation, or heterocoagulation of the resin particles with the pigment particles; and which, on further stirring for about 1 to about 3 hours while heating, for example, from about 35° to about 45° C., results in the formation of statically bound aggregates ranging in size of from about 0.5 micron to about 10 microns in average diameter size as measured by the Coulter Counter (Microsizer II), where the size of those aggregated particles and their distribution can be controlled by the temperature of heating, for example from about 5° to about 25° C. below the resin Tg, and where the speed at which toner size aggregates are formed can also be controlled by the temperature. Thereafter, heating from about 5° to about 50° C. above the resin Tg provides for particle fusion or coalescence of the polymer and pigment particles; followed by optional washing with, for example, hot water to remove surfactant, and drying whereby toner particles comprised of resin and pigment with various particle size diameters can be obtained, such as from 1 to about 20, and preferably 12 microns in average volume particle diameter. The aforementioned toners are especially useful for the development of colored images with excellent line and solid resolution, and wherein substantially no background deposits are present.

While not being desired to be limited by theory, it is believed that the flocculation or heterocoagulation is caused by the neutralization of the pigment mixture containing the pigment and ionic, such as cationic, surfactant absorbed on the pigment surface with the resin mixture containing the resin particles and anionic surfactant absorbed on the resin particle. This process is kinetically controlled and an increase of, for example, from about 25° to about 45° C. of the temperature increases the flocculation, increasing from about 2.5 to 6 microns the size of the aggregated particles formed, and with a GSD charge of from about 1.39 to about 1.20 as measured on the Coulter Counter; the GSD is thus narrowed down since at high 45° to 55° C. (5° to 10° C. below the resin Tg) temperature the mobility of the particles increases, and as a result all the fines and submicron size particles are collected much faster, for example 14 hours as opposed to 2 hours, and more efficiently. Thereafter, heating the aggregates, for example, from about 5° to about 80° C. above the resin Tg fuses the aggregated particles or coalesces the particles to enable the formation of toner composites of polymer, pigments and optional toner additives like charge control agents, and the like, such as waxes. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing, and thereby forming statically bounded aggregate particles by stirring and heating below the resin Tg; and thereafter, that is when the aggregates are formed, heating above the resin Tg to form stable toner composite particles. Of importance with respect to the processes of the present invention in embodiments is computer controlling the temperature of the heating to form the aggregates since the temperature can affect the rate of aggregation, the size of the aggregates and the particle size distribution of the aggregates. More specifically, the formation of aggregates is much faster, for example 6 to 7 times, when the temperature is 20° C. higher than room temperature, about 25° C., and the size of the aggregated particles, from 2.5 to 6 microns, increases with an increase in temperature. Also, an increase in the temperature of heating from room temperature to 45° C. improves the particle size distribution, for example with an increase in temperature below the resin Tg the particle size distribution, believed due to the faster collection of submicron particles, improves significantly. The latex blend or emulsion is comprised of resin or polymer, counterionic surfactant, and nonionic surfactant.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, an average volume particle of from about 2 to about 11 microns and preferably less than about 7 microns, and with narrow geometric size distribution (GSD) of from about 1.16 to about 1.3. Additionally, in some xerographic systems wherein process color is utilized, such as pictorial color applications, small particle size colored toners, preferably of from about 3 to about 9 microns, are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. These and other disadvantages and problems are avoided or minimized with the toners and processes of the present invention. It is preferable to use small toner particle sizes such as from about 1 to 7 microns and with higher pigment loading such as from about 5 to about 12° percent by weight of toner, such that the mass of toner layers deposited onto paper is reduced to obtain the same quality of image and resulting in a thinner plastic toner layer on paper after fusing, thereby minimizing or avoiding paper curling. Toners prepared in accordance with the present invention enable in embodiments the use of lower image fusing temperatures, such as from about 120° to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns and fixing thereafter, results in a low gloss toner image of from about 1 to about 30 gloss units as measured by the Gardner Gloss metering unit. Alternatively, when higher image gloss is desired, such as from about 30 to about 60 gloss units as measured by the Gardner Gloss metering unit, higher gloss paper is utilized, such as from about 30 to about 60 gloss units, and which after image formation with small particle size toners of the present invention of preferably from about 3 to about 5 microns and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns, whereby the pile height of the toner layer or layers is considered low and acceptable.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 3 microns to about 9, and preferably 5 microns, are attained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments of the present invention. In addition, by the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. The process of the present invention does not need to utilize polymer polar acid groups, and toners can be prepared with resins, such as poly(styrenebutadiene) or PLIOTONE TM, containing no polar acid groups. Additionally, the process of the '127 patent does not appear to utilize counterionic surfactant and flocculation processes, and does not appear to use a counterionic surfactant for dispersing the pigment. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with a wide GSD. Furthermore, the '488 patent does not, it appears, disclose the process of counterionic, for example controlled aggregation is obtained by changing the counterionic strength, flocculation. Similarly, the aforementioned disadvantages, for example poor GSD are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

The process described in the present application has several advantages as indicated herein including in embodiments the effective preparation of small toner particles with narrow particle size distribution as a result of no classification; yields of toner are high; large amounts of power consumption are avoided; the process can be completed in rapid times therefore rendering it attractive and economical; and it is a controllable process since the particle size of the toner can be rigidly controlled by, for example, controlling the temperature of the aggregation.

In (D/92277), now U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. Additionally, there is illustrated in (D/92097), now U.S. Pat. No. 5,278,020, the disclosure of which is totally incorporated herein by reference, a process for the preparation of a toner composition comprising the steps of (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;

(ii) polymerizing the latex emulsion mixture by heating from ambient temperature to about 80° C. to form nonpolar olefinic emulsion resin particles of volume average diameter of from about 5 nanometers to about 500 nanometers;

(iii) diluting the nonpolar olefinic emulsion resin particle mixture with water;

(iv) adding to the diluted resin particle mixture a colorant or pigment particles and optionally dispersing the resulting mixture with a homogenizer;

(v) adding a cationic surfactant to flocculate the colorant or pigment particles to the surface of the emulsion resin particles;

(vi) homogenizing the flocculated mixture at high shear to form statically bound aggregated composite particles with a volume average diameter of less than or equal to about 5 microns;

(vii) heating the statically bound aggregate composite particles to form nonpolar toner sized particles;

(viii) halogenating the nonpolar toner sized particles to form nonpolar toner sized particles having a halopolymer resin outer surface or encapsulating shell; and (ix) isolating the non polar toner sized composite particles.

In, U.S. Pat. No. 5,308,734 (D/92576), the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In copending patent application U.S. patent application Ser. No. 022,575 (D/92577), the disclosure of which is totally incorporated herein by reference, there is illustrated a process for the preparation of toner compositions comprising (i) preparing a pigment dispersion in water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles above the resin Tg to form said toner composition comprised of polymeric resin, pigment and optionally a charge control agent.

There are a number of advantages of the processes of the present invention compared to those illustrated in the copending patent applications including, for example, the following. The yield of toner is high and the amount of waste materials is less than 1 percent since at higher temperatures, 35° to 55° C. or 5° to 15° C. below the resin Tg, substantially all the submicrons particles are being aggregated; the process is very rapid at higher temperatures, 35° to 55° C. or 5° to 15° C. below the resin Tg, and can be completed within 0.5 hour. With the present invention in embodiments, the temperature is an important factor in controlling the size of the aggregated particles, and affects the particle size distribution. Also, with the present invention the entire process of aggregation of submicron particles to toner sized particles can be shortened significantly, for example from 35 hours to 7 hours, since an increase from room temperature to 45° C. or 5° to 15° C. below the resin Tg in the temperature speeds up the process by up to 10 times. For example, rather than aggregating the particles for 12 or more hours, the aggregation can be completed, that is all the submicron particles can be aggregated, within a time frame of from about ½ hour to 3 hours, which is of importance from scale-up and economical aspects.

In copending patent application U.S. patent application Ser. No. (082,651-(D/93105), filed concurrently herewith, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In copending U.S. patent application Ser. No. 083,146(D/93106), filed concurrently herewith, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In copending U.S. patent application Ser. No. (083,157 (D/93107), filed concurrently herewith, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In copending U.S. patent application Ser. No. 082,741 (D/93108), filed concurrently herewith, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In copending U.S. patent application Ser. No. (083,116 (D/93111), filed concurrently herewith, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) surfactant and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to I weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process comprised of (i) preparing a cationic pigment mixture containing pigment particles, and optionally charge control agents and other known optional additives dispersed in a water containing a cationic surfactant by shearing, microfluidizing or ultrasonifying; (ii) shearing the pigment mixture with a latex mixture comprised of a polymer resin, anionic surfactant and nonionic surfactant thereby causing a flocculation of the latex particles with pigment particles, which on further stirring allows for the formation of electrostatically stable aggregates of from about 0.5 to about 5 microns in volume diameter as measured by the Coulter Counter; (iii) adding additional, for example 1 to 10 weight percent of anionic or nonionic surfactant to the formed aggregates to, for example, increase their stability and to retain the particle size and particle size distribution during the heating stage; and (iv) coalescing or fusing the aforementioned aggregated particle mixture by heat to toner composites, or a toner composition comprised of resin, pigment, and charge additive.

In a further object of the present invention there is provided a process for the preparation of toner compositions with an average particle volume diameter of from between about I to about 20 microns, and preferably from about I to about 7 microns, and with a narrow GSD of from about 1.2 to about 1.3 and preferably from about 1.16 to about 1.25 as measured by a Coulter Counter.

In a further object of the present invention there is provided a process for the preparation of toner compositions with certain effective particle sizes by controlling the temperature of the aggregation which comprises stirring and heating about below the resin glass transition temperature (Tg).

In a further object of the present invention there is provided a process for the preparation of toners with particle size distribution which can be improved from 1.4 to about 1.16 as measured by the Coulter Counter by increasing the temperature of aggregation from about 25° C. to about 45° C.

In a further object of the present invention there is provided a process that is rapid as, for example, the aggregation time can be reduced to below 1 to 3 hours by increasing the temperature from room, about 25° C., temperature (RT) to a temperature below 5° to 20° C. Tg and wherein the process consumes from about 2 to about 8 hours.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment and optional charge control agent in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

Another object of the present invention resides in processes for the preparation of small sized toner particles with narrow GSDs, and excellent pigment dispersion by the aggregation of latex particles with pigment particles dispersed in water and a surfactant, and wherein the aggregated particles of toner size can then be caused to coalesce by, for example, heating. In embodiments, some factors of interest with respect to controlling particle size and particle size distribution include the concentration of the surfactant used for the pigment dispersion, the concentration of the resin component like acrylic acid in the latex, the temperature of coalescence, and the time of coalescence.

In another object of the present invention there are provided processes for the preparation of toner comprised of resin and pigment, which toner can be of a preselected size, such as from about 1 to about 10 microns in volume average diameter, and with narrow GSD by the aggregation of latex or emulsion particles, which aggregation can be accomplished with stirring in excess of 25° C., and below about the Tg of the toner resin, for example at 45° C., followed by heating the formed aggregates above about the resin Tg to allow for coalescence; an essentially three step process of blending, aggregation and coalescence; and which process can in embodiments be completed in 8 or less hours. The process can comprise dispersing pigment particles in water/cationic surfactant using microfluidizer; blended the dispersion with a latex using a SD41 mixer, which allows continuous pumping and shearing at high speed, which is selected to break initially formed flocks or flocks, thus allowing controlled growth of the particles and better particle size distribution; the pigment-/latex blend is then transferred into the kettle equipped with a mechanical stirrer and a temperature probe, and heated up to 35° C. or 45° C. to perform the aggregation. Negatively charged latex particles are aggregating with pigment particles dispersed in cationic surfactant and the aggregation can be continued for 3 hours. This is usually sufficient time to provide a narrow GSD. The temperature is a factor in controlling the particle size and GSD in the initial stage of aggregation (kinetically controlled), the lower the temperature of aggregation, the smaller the particles; and the particle size and GSD achieved in the aggregation step can be "frozen" by addition of extra anionic surfactant prior to the coalescence. The resulting aggregated particles are heated 20° to 30° C. above their polymer Tg for coalescence; particles are filtered on the Buchner funnel and washed with hot water to remove the surfactants; and the particles are dried in a freeze dryer, spray dryer, or fluid bed dried.

These and other objects of the present invention are accomplished in embodiments by the provision of toners and processes thereof. In embodiments of the present invention, there are provided processes for the economical direct preparation of toner compositions by improved flocculation or heterocoagulation, and coalescence and wherein the temperature of aggregation can be utilized to control the final toner particle size, that is average volume diameter.

In embodiments, the present invention is directed to processes for the preparation of toner compositions which comprises initially attaining or generating an ionic pigment dispersion, for example dispersing an aqueous mixture of a pigment or pigments, such as carbon black like REGAL 330®, phthalocyanine, quinacridone or RHODAMINE B™ type with a cationic surfactant, such as benzalkonium chloride, by utilizing a high shearing device, such as a Brinkmann Polytron, thereafter shearing this mixture by utilizing a high shearing device, such as a Brinkmann Polytron, a sonicator or microfluidizer with a suspended resin mixture comprised of polymer components such as poly(styrene butadiene) or poly(styrene butylacrylate); and wherein the particle size of the suspended resin mixture is, for example, from about 0.01 to about 0.5 micron in an aqueous surfactant mixture containing an anionic surfactant such as sodium dodecylbenzene sulfonate and nonionic surfactant; resulting in a flocculation, or heterocoagulation of the polymer or resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating below about the resin Tg, for example from about 5° to about 15° C., and allowing the formation of electrostatically stabilized aggregates ranging from about 0.5 micron to about 10 microns; followed by heating above about the resin Tg, for example from about 5° to about 50° C., to cause coalescence of the latex, pigment particles and followed by washing with, for example, hot water to remove, for example, surfactant, and drying such as by use of an Aeromatic fluid bed dryer, freeze dryer, or spray dryer; whereby toner particles comprised of resin pigment, and optional charge control additive with various particle size diameters can be obtained, such as from about 1 to about 10 microns in average volume particle diameter as measured by the Coulter Counter.

Embodiments of the present invention include a process for the preparation of toner compositions comprised of resin and pigment comprising (i) preparing a pigment dispersion in a water, which dispersion is comprised of a pigment, an ionic surfactant and optionally a charge control agent;

(ii) shearing the pigment dispersion with a latex mixture comprised of polymeric or resin particles in water and counterionic surfactant with a charge polarity of opposite sign to that of said ionic surfactant, and a nonionic surfactant;

(iii) heating the resulting homogenized mixture below about the resin Tg at a temperature of from about 35° to about 50° C. (or 5° to 20° C. below the resin Tg) thereby causing flocculation or heterocoagulation of the formed particles of pigment, resin and charge control agent to form electrostatically bounded toner size aggregates; and (iv) heating to, for example, from about 60° to about 95° C. the statically bound aggregated particles of (iii) to form said toner composition comprised of polymeric resin and pigment.

Also, in embodiments the present invention is directed to processes for the preparation of toner compositions which comprise (i) preparing an ionic pigment mixture by dispersing a pigment such as carbon black like REGAL 330™, HOSTAPERM PINK™, or PV FAST BLUE™ of from about 2 to about 10 percent by weight of toner in an aqueous mixture containing a cationic surfactant such as dialkylbenzene dialkylammonium chloride like SANIZOL B-50™ available from Kao or MIRAPOL™ available from Alkaril Chemicals, and from about 0.5 to about 2 percent by weight of water utilizing a high shearing device such as a Brinkmann Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrene-butylmethacrylate), PLIOTONE TM or poly(styrenebutadiene) and which resin particles are present in various effective amounts, such as from about 40 percent to about 98 percent by weight of the toner, and wherein the polymer resin latex particle size is from about 0.1 micron to about 3 microns in volume average diameter, and counterionic surfactant such as an anionic surfactant like sodium dodecylsulfate, dodecylbenzene sulfonate or NEOGEN R TM from about 0.5 to about 2 percent by weight of water, a nonionic surfactant such polyethylene glycol or polyoxyethylene glycol nonyl phenyl ether or IGEPAL 897 TM obtained from GAF Chemical Company, from about 0.5 to about 3 percent by weight of water, thereby causing a flocculation or heterocoagulation of pigment, charge control additive and resin particles; (iii) diluting the mixture with water to enable from about 50 percent to about 15 percent of solids; (iv) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment, and further stirring with a mechanical stirrer from about 250 to 500 rpm about below the resin Tg at, for example, about 5° to 15° C. below the resin Tg at temperatures of about 35° to 50° C. to form electrostatically stable aggregates of from about 0.5 micron to about 5 microns in average volume diameter; (v) adding additional anionic surfactant or nonionic surfactant in the amount of from 0.5 percent to 5 percent by weight of water to stabilize the aggregates formed in step (iv), heating the statically bound aggregate composite particles at from about 60° C. to about 135° C. for a duration of about 60 minutes to about 600 minutes to form toner sized particles of from about 3 microns to about 7 microns in volume average diameter and with a geometric size distribution of from about 1.2 to about 1.3 as measured by the Coulter Counter; and (vi) isolating the toner sized particles by washing, filtering and drying thereby providing composite toner particles comprised of resin and pigment. Flow additives to improve flow characteristics and charge additives, if not initially present, to improve charging characteristics may then be added by blending with the formed toner, such additives including AEROSILS TM or silicas, metal oxides like tin, titanium and the like, metal salts of fatty acids, like zinc stearate, and which additives are present in various effective amounts, such as from about 0.1 to about 10 percent by weight of the toner. The continuous stirring in step (iii) can be accomplished as indicated herein, and generally can be effected at from about 200 to about 1,000 rpm for from about 1 hour to about 24 hours, and preferably from about 12 to about 6 hours.

One preferred method of obtaining the pigment dispersion depends on the form of the pigment utilized. In some instances, pigments available in the wet cake form or concentrated form containing water can be easily dispersed utilizing a homogenizer or stirring. In other instances, pigments are available in a dry form, whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator, with the optional addition of dispersing agents such as the aforementioned ionic or nonionic surfactants.

In embodiments, the present invention relates to a process for the preparation of toner compositions with controlled particle size comprising:

(i) preparing a pigment dispersion in water, which dispersion is comprised of a pigment, an ionic surfactant and optionally a charge control agent;

(ii) shearing the pigment dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids;

(iii) heating, for example, from about 35° to about 50° C. the sheared blend at temperatures below the about or equal resin Tg, for example from about 5° to about 20° C., while continuously stirring to form electrostatically bounded relatively stable (for Coulter Counter measurements) toner size aggregates with narrow particle size distribution;

(iv) heating, for example from about 60° to about 95° C., the statically bound aggregated particles at temperatures of about 5° to 50° C. above the resin Tg of wherein the resin Tg is in the range of about 50, preferably 52° to about 65° C. to enable a mechanically stable, morphologically useful forms of said toner composition comprised of polymeric resin, pigment and optionally a charge control agent;

(v) separating the toner particles from the water by filtration; and (vi) drying the toner particles.

Embodiments of the present invention include a process for the preparation of toner compositions with controlled particle size comprising:

(i) preparing a pigment dispersion in water, which dispersion is comprised of a pigment of a diameter of from about 0.01 to about 1 micron, an ionic surfactant, and optionally a charge control agent;

(ii) shearing the pigment dispersion with a latex blend comprised of resin particles of submicron size of from about 0.01 to about 1 micron, a counterionic surfactant with a charge polarity, positive or negative, of opposite sign to that of said ionic surfactant and a nonionic surfactant thereby causing a flocculation or heterocoagulation of the formed particles of pigment, resin and charge control agent to form a uniform dispersion of solids in the water and surfactant system;

(iii) heating the above sheared blend at a temperature of from about 5° to about 20° C. below the Tg of the resin particles while continuously stirring to form electrostatically bound or attached relatively stable (for Coulter Counter measurements) toner size aggregates with a narrow particle size distribution;

(iv) heating the statically bound aggregated particles at a temperature of from about 5° to about 50° C. above the Tg of the resin to provide a mechanically stable, toner composition comprised of polymeric resin, pigment and optionally a charge control agent;

(v) separating the said toner particles from the water by filtration; and (vi) drying the said toner particles.

In embodiments, the present invention is directed to a process for the preparation of toner compositions with controlled particle size comprising:

(i) preparing a pigment dispersion in water, which dispersion is comprised of a pigment, an ionic surfactant and optionally a charge control agent;

(ii) shearing the pigment dispersion with a latex blend comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the water and surfactant;

(iii) heating the above sheared blend below about or about equal to the glass transition temperature (Tg) of the resin while continuously stirring to form electrostatically bound toner size aggregates with a narrow particle size distribution;

(iv) heating the statically bound aggregated particles about above or about equal to the Tg of the resin to provide a toner composition comprised of polymeric resin, pigment and optionally a charge control agent;

(v) separating said toner particles from said water by filtration; and (vi) drying said toner particles.

In embodiments, the heating in (iii) is accomplished at a temperature of from about 29° to about 59° C.; the resin Tg in (iii) is from about 50° to about 80° C.; heating in (iv) is from about 5° to about 50° C. above the Tg; and wherein the resin Tg in (iv) is from about 50° to about 80° C.

In embodiments, heating below the glass transition temperature (Tg) can include heating at about the glass transition temperature or slightly higher. Heating above the Tg can include heating at about the Tg or slightly below the Tg, in embodiments.

Embodiments of the present invention include a process for the preparation of toner compositions with controlled particle size comprising:

(i) preparing a pigment dispersion in water, which dispersion is comprised of a pigment of a diameter of from about 0.01 to about 1 micron, an ionic surfactant, and optionally a charge control agent;

(ii) shearing the pigment dispersion with a latex blend comprised of resin particles of submicron size of from about 0.01 to about 1 micron, a counterionic surfactant with a charge polarity, for example positive or negative, of opposite sign to that of said ionic surfactant, which can be positive or negative, and a nonionic surfactant thereby causing a flocculation or heterocoagulation of the formed particles of pigment, resin and charge control agent to form a uniform dispersion of solids in the water and surfactant;

(iii) heating the above sheared blend at a temperature of from about 5° to about 20° C., and in embodiments about zero to about 20° C below the Tg of the resin particles while continuously stirring to form electrostatically bounded or bound relatively stable (for Coulter Counter measurements) toner size aggregates with a narrow particle size distribution;

(iv) heating the statically bound aggregated particles at a temperature at from about 5 to about 50° C, and in embodiments about zero to about 50° C. above the Tg of the resin to provide a mechanically stable toner composition comprised of polymeric resin, pigment and optionally a charge control agent;

(v) separating the toner particles from the water by filtration;

(vi) drying the toner particles.

In embodiments, the present invention is directed to a process for the preparation of toner compositions with controlled particle size comprising:

(i) preparing a pigment dispersion in water, which dispersion is comprised of a pigment and an ionic surfactant;

(ii) shearing the pigment dispersion with a latex blend comprised of resin of submicron size, a counterionic surfactant with a charge polarity of opposite sign to that of said ionic surfactant and a nonionic surfactant thereby causing a flocculation or heterocoagulation of the formed particles of pigment and resin to form a uniform dispersion of solids in the water and surfactant;

(iii) heating the above sheared blend below about the glass transition temperature (Tg) of the resin while continuously stirring to form electrostatically bounded or bound toner size aggregates with a narrow particle size distribution; and (iv) heating the statically bound aggregated particles above about the Tg of the resin to provide a toner composition comprised of polymeric resin and pigment. Toner and developer compositions thereof are also encompassed by the present invention in embodiments.

Illustrative examples of specific resin particles, resins or polymers selected for the process of the present invention include known polymers such as poly(styrene-butadiene), poly(para-methyl styrene-butadiene), poly(-meta-methyl styrene-butadiene), poly(alpha-methyl styrene-butadiene), poly(methylmethacrylate-butadiene), poly(ethylmethacrylatebutadiene), poly(propylmethacrylate-butadiene), poly(butylmethacrylatebutadiene), poly(methylacrylate-butadiene), poly(ethylacrylate-butadiene), poly(propylacrylate-butadiene), poly(-butylacrylate-butadiene), poly(styrene-isoprene), poly(-para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(-propylacrylate-isoprene), and poly(butylacrylate-isoprene); polymers such as poly(styrene-butadiene-acrylic acid), poly(styrene-butadienemethacrylic acid), PLIOTONE TM available from Goodyear, polyethyleneterephthalate, polypropylene-terephthalate, polybutylene-terephthalate, polypentylene-terephthalate, polyhexalene-terephthalate, polyheptadeneterephthalate, polyoctalene-terephthalate, POLYLITE TM (Reichhold Chemical Inc), PLASTHALL TM (Rohm & Hass), CYGAL TM (American Cyanamide), ARMCO TM (Armco Composites), CELANEX TM (Celanese Eng), RYNITE TM (DuPont), STYPOL TM, and the like. The resin selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about I micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

The resin selected for the process of the present invention is preferably prepared from emulsion polymerization methods, and the monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional and such groups can be present in various amounts of from about0.1 to about 10 percent by weight of the polymer resin. Known chain transfer agents, for example dodecanethiol, about I to about 10 percent, or carbon tetrabromide in effective amounts, such as from about 1 to about 10 percent, can also be selected when preparing the resin particles by emulsion polymerization. Other processes of obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654 (D/92277), the disclosure of which is totally incorporated herein by reference, mechanical grinding processes, or other known processes.

Various known colorants or pigments present in the toner in an effective amount of, for example, from about I to about 25 percent by weight of the toner, and preferably in an amount of from about 1 to about 15 weight percent, that can be selected include carbon black like REGAL 330®; magnetites, such as Mobay magnetites MO8029 TM, MO8060 TM; Columbian magnetites; MAPICO BLACKS TM and surface treated magnetites; Pfizer magnetites CB4799 TM, CB5300 TM, CB5600 TM, MCX6369 TM; Bayer magnetites, BAYFERROX 8600 TM, 8610 TM; Northern Pigments magnetites, NP-604 TM, NP-608 TM; Magnox magnetites TMB-100 TM, or TMB-104 TM; and the like. As colored pigments, there can be selected cyan, magenta, yellow, red, green, brown, blue or mixtures thereof. Specific examples of pigments include phthalocyanine HELIOGEN BLUE L6900 TM, D6840 TM, D7080 TM, D7020 TM, PYLAM OIL BLUE TM, PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAPERM YELLOW FGL TM, HOSTAPERM PINK E TM from Hoechst, and CINQUASIA MAGENTA TM available from E.I. DuPont de Nemours & Company, and the like, Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM, and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R TM, NEOGEN SC TM obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL TM and ALKAQUAT TM available from Alkaril Chemical Company, SANIZOL TM (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R TM, NEOGEN SC TM obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from RhonePoulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregated comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

Pigment dispersion: 14 grams of dry pigment PV FAST BLUE TM and 2.92 grams of cationic surfactant SANIZOL B-50 TM were dispersed in 400 grams of water using an ultrasonic probe.

A polymeric or emulsion latex was prepared by the emulsion polymerization of styrene/butylacrylate/acrylic acid (82/18/2 parts) in nonionic/anionic surfactant solution (3 percent) as follows. 352 Grams of styrene, 48 grams of butyl acrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether TM nonionic surfactant (ANTAROX 897 TM —70 percent active), and 4 grams of ammonium persulfate initiator were dissolved. The emulsion was then polymerized at 70° C. for 8 hours. The resulting latex, 60 percent water and 40 percent (weight percent throughout) solids comprised of a copolymer of polystyrene/polybutyl acrylate/polyacrylic acid, 82/18/2; the Tg of the latex dry sample was 53.1° C., as measured on a DuPont DSC; $M_w$=26,600, and $M_n$=1,200 as determined on Hewlett Packard GPC. The zeta potential as measured on Pen Kern Inc. Laser Zee Meter was -80 millivolts for the polymeric latex. The particle size of the latex as measured on Brookhaven BI-90 Particle Nanosizer was 147 nanometers. The aforementioned latex was then selected for the toner preparation of Example I and IA.

Preparation of Toner Size Particles, Aggregation at Elevated Temperature Performed at 45° C.:

Preparation of the aggregated particles: the above dispersion of the PV FAST BLUE TM was placed in the SD41 continuous blender. 2.92 Grams of SANIZOL B-50 TM in 400 milliliters of deionized water were also added. The aforementioned pigment dispersion was sheared for 3 minutes at 10,000 rpm. 650 Grams of the above latex were added while shearing. Shearing was continued for an extra 8 minutes at 10,000 rpm. 400 Grams of this blend were than transferred into a kettle placed in the heating mantle and equipped with mechanical stirrer and temperature probe. The temperature of the mixture was raised from 25° C. (room temperature) to 45° C., step (iii), and this aggregation was performed for 24 hours.

Coalescence of aggregated particles: 40 milliliters of a 20 percent solution of anionic surfactant (NEOGEN R TM) were added while stirring prior to raising the temperature of the aggregated particles in the kettle to 80° C. The heating was continued at 80° C. for 3 hours to coalesce the aggregated particles. No change in the particle size and the GSD was observed, compared to the size of the aggregates. Particles were filtered, washed using hot deionized water, and dried on the freeze dryer. The resulting cyan toner was comprised of 95° percent resin of poly(styrene-co-butylacrylate-co-acrylic acid), and 5° percent of PV FAST BLUE TM pigment. Toner aggregates particle size as measured on the Coulter Counter after 1 hour and 24 hours was 4.2 microns average volume diameter, and the GSD was 1.25.

COMPARATIVE EXAMPLE IA

Aggregation of Styrene/Butylacrylate/Acrylic Acid Latex with Cyan Pigment at 25° C.:

Pigment dispersion: (same as Example I) 14 grams of dry pigment PV FAST BLUE TM and 2.92 grams of cationic surfactant SANIZOL B-50 TM were dispersed in 400 grams of water using an ultrasonic probe.

A polymeric latex (same as Example I) was prepared in emulsion polymerization of styrene/butylacrylate/acrylic acid (82/18/2 parts) in nonionic/anionic surfactant solution (3 percent) as follows. 352 Grams of styrene, 48 grams of butyl acrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM −70 percent active), and 4 grams of ammonium persulfate initiator were dissolved. The emulsion was then polymerized at 70° C. for 8 hours. The resulting latex contained 60 percent of water and 40 percent of solids of 82/18/2 polystrene/polybutylacrylate/polyacrylic acid; the Tg of the latex dry sample was 53.1° C., as measured on a DuPont DSC; $M_w$=26,600, and $M_n$=1,200 as determined on a Hewlett Packard GPC. The zeta potential as measured on Pen Kern Inc. Laser Zee Meter was −80 millivolts. The particle size of the latex as measured on Brookhaven Bl-90 Particle Nanosizer was 147 nanometers. The aforementioned latex was then selected for the toner preparation of Example IA.

Preparation of Toner Size Particles, Aggregation Performed at Room Temperature, 25° C.:

Preparation of the aggregated particles: The above dispersion of the PV FAST BLUE TM was placed in the SD41 continuous blender. 2.92 Grams of SANIZOL B-50 TM in 400 milliliters of deionized water were also added. The pigment dispersion was then sheared for 3 minutes at 10,000 rpm and 650 grams of above latex were added while shearing. Shearing was continued for an extra 8 minutes at 10,000 rpm. 400 Grams of this blend were than transferred into a kettle equipped with mechanical stirrer and temperature probe. The temperature of the mixture was retained at 25° C. and the aggregation was performed for 24 hours at 25° C. Subsequent to heating the aggregates as in Example I, toner aggregates particle size was measured on the Coulter Counter after 1 hour and 24 hours, and compared with the size of the aggregated particles obtained at 45° C. (Example I: and Table 1).

Coalescence of aggregated particles: 40 milliliters of a 20 percent solution of anionic surfactant (NEOGEN R TM) were added while stirring prior to raising the temperature of the aggregated particles in the kettle to 80° C. The heating was continued at 80° C. for 3 hours to coalesce the aggregated particles. No change in the particle size and the GSD was observed, compared to the size of the aggregates. The particles were filtered, washed using hot deionized water and dried on the freeze dryer. The resulting cyan toner was comprised of 95 percent resin of poly(styrene-co-butylacrylate-co-acrylic acid) and 5 percent of PV FAST BLUE TM pigment.

TABLE 1

Effect of the Temperature on Particle Size and GSD in Aggregation Process

| TIME OF AGGREGATION | EXAMPLE I TEMPERATURE OF AGGREGATION 45° C. | | EXAMPLE IA TEMPERATURE OF AGGREGATION 25° C. | |
|---|---|---|---|---|
| | Part. Size | GSD | Part. Size | GSD |
| 1 hour | 4.2 | 1.25 | 2.6 | 1.34 |
| 24 hours | 4.2 | 1.24 | 3.9 | 1.28 |

Conditions and parameters were kept constant: Cationic surfactant (SANIZOL B-50 TM :1:1 341 ratio).

Latex: RI-223 (137 nanometers, −70 millivolts), styrene/butyl acrylate/acrylic acid (80/20/2 in parts).

Pigment: PV FAST BLUE TM (dry dispersed in SANIZOL B-50 TM /water in a microfluidizer).

From the above Example the particle size of the sample aggregated at 45° C. is larger than those aggregated at 25° C., the particle size distribution is also superior at higher temperature (1.25 compared to 1.34 or 1.28), and the process of aggregation is completed within I hour at 45° C. whereas at 25° C. the process was not fully completed until 24 hours.

EXAMPLE II

Kinetic Aggregation at 35° C.

The process of Example [was essentially repeated.

Pigment dispersion: 280 grams of dry pigment PV FAST BLUE TM and 58.5 grams of cationic surfactant SANIZOL B-50 TM were dispersed in 8,000 grams of water using a microfluidizer.

A polymeric latex was prepared by the emulsion polymerization of styrene/butylacrylate/acrylic acid (80/20/2 parts) in the nonionic/anionic surfactant solution (NEOGEN R TM /IGEPAL CA 897 TM (3 percent). The latex contained 60 percent of water and 40 percent of solids of polystyrene/polybutylacrylate/-polyacrylic acid. The Tg of the resulting latex sample after drying on the freeze dryer was 53.0° C. The molecular weight of the latex sample was $M_w$=20,200, $M_n$=5,800. The zeta-potential was −80 millivolts.

Kinetic Study of Aggregation At 35° C.

Preparation of the aggregated particles: 540 grams of the above PV FAST BLUE TM dispersion were added simultaneously with 850 grams of the above prepared latex into the SD41 continuous blending device containing 780 milliliters of water with 5.85 grams of cationic surfactant SANIZOL B-50 TM The pigment dispersion and the latex were well mixed by continuous pumping through the rotor stator operating at 10,000 rpm for 8 minutes. This homogeneous, creamy blend was then transferred into kettles placed in heating mantles and equipped with mechanical stirrers and temperature probes. The temperature in one kettle was raised to 35° C. and particle growth was monitored on the Coulter Counter every 30 minutes (see Table 2).

Coalescence of aggregated particles: The temperature of the aggregated particles in the kettle was raised to 80° C. at 1° /minute. When it, the kettle, reached a temperature of 40° C., 40 milliliters of a 20 percent solution of anionic surfactant (NEOGEN R TM) were added while stirring. The heating was continued at 80° C. for 3 hours to coalesce the aggregated particles. No change in the particle size and the GSD was observed, compared to the size of the aggregates. The resulting cyan toner comprised of 95 percent of resin of poly(-styrene/butylacrylate/acrylic acid) and 5 percent of PV FAST BLUE TM pigment particles was filtered, washed using deionized water, and dried on a freeze dryer.

EXAMPLE III

The process of Example H was essentially repeated.

Pigment dispersion: 280 grams of dry pigment PV FAST BLUE TM and 58.5 grams of cationic surfactant SANIZOL B-50 TM were dispersed in 8,000 grams of water using a microfluidizer.

A polymeric latex was prepared by the emulsion polymerization of styrene/butylacrylate/acrylic acid (80/20/2 parts) in a nonionic/anionic surfactant solution (NEOGEN R TM /IGEPAL CA 897 TM, 3 percent). The latex contained 60 percent of water and 40 percent of solids; the Tg of the latex sample after drying on the freeze dryer was 53.0° C.; the molecular weight of the latex sample was Mw=20,200, Mn=5,800. The zeta-potential was −80 millivolts.

Kinetic Study of the Aggregation at 45° C.

Preparation of the aggregated particles: 540 grams of the above PV FAST BLUE TM dispersion were added simultaneously with 850 grams of the above latex into the 5D41 continuous blending device containing 780 milliliters of water with 5.85 grams of cationic surfactant SANIZOL B-50 TM. The pigment dispersion and the latex were well mixed by continuous pumping through the rotor stator operating at 10,000 RPM for 8 minutes. This homogeneous, creamy blend was then transferred into a kettle placed in the heating mantle and equipped with mechanical stirrer and temperature probe. The temperature in the kettle was raised from room temperature to 45° C. and particle growth was monitored on the Coulter Counter every 30 minutes (see Table 2). After this preparation, the aggregated particles are loosely bound, but sufficiently stable to enable measurement.

Coalescence of aggregated particles: the temperature of the aggregated particles in the kettle was raised to 80° C. at 1° /minute. When it (the kettle) reached a temperature of 48° C., 40 milliliters of 20 percent solution of anionic surfactant (NEOGEN R TM ) were added while stirring. The heating was continued at 80° C. for 3 hours to coalesce the aggregated particles into toner of resin and pigment PV FAST BLUE TM No change in the particle size and the GSD was observed, compared to the size of the aggregates prepared above (Kinetic Study of the Aggregation at 45° C.), see Table 2.

TABLE 2

Particle Size and GSD in Aggregation Process/Kinetic Studies

| TIME OF AGGREGATION | TEMPERATURE OF AGGREGATION 35° C. EXAMPLE II | | TEMPERATURE OF AGGREGATION 45° C. EXAMPLE III | |
|---|---|---|---|---|
| | Part. Size | GSD | Part. Size | GSD |
| Agg/30 min. | 2.4 | 1.57 | 5.6 | 1.23 |
| Agg/60 min. | 3.5 | 1.38 | 6.1 | 1.22 |
| Agg/90 min. | 4.4 | 1.24 | 6.3 | 1.21 |
| Agg/120 min. | 4.4 | 1.24 | 6.6 | 1.22 |
| Agg/180 min. | 4.5 | 1.23 | 6.5 | 1.2 |
| Agg/22 hrs. | 4.8 | 1.23 | — | — |
| Heat/3 hrs./80° C. | 4.8 | 1.23 | 6.8 | 1.21 |

Conditions and parameters remained constant: Cationic surfactant (SANIZOL B-50 TM ; 5:1 ratio).

Latex: (147 nanometers, −80 millivolts), styrene/butyl acrylate/acrylic acid (80/20/2 in parts).

Pigment: PV FAST BLUE TM (dry dispersed in SANIZOL B-50 TM /water in a microfluidizer.

The results evidence, for example, that a 10° degree difference in the aggregation temperature has an effect on the particle size. The aggregate particle size achieved after the same time (180 minutes) is 4.5 at 35° C. compared to 6.5 at 45° C. The particle size distribution (GSD) at any given point in time is superior at 45° C. compared to 35° C. The aggregation process proceeds faster at 45° C. compared to 35° C. as indicated by the GSDs obtained.

GRAPH 1 - Effect of Temperature on Aggregation
Particle Size and GSD of Aggregates as a Function of the Temperature (Molar Surfactants Ratio 1.5:1)

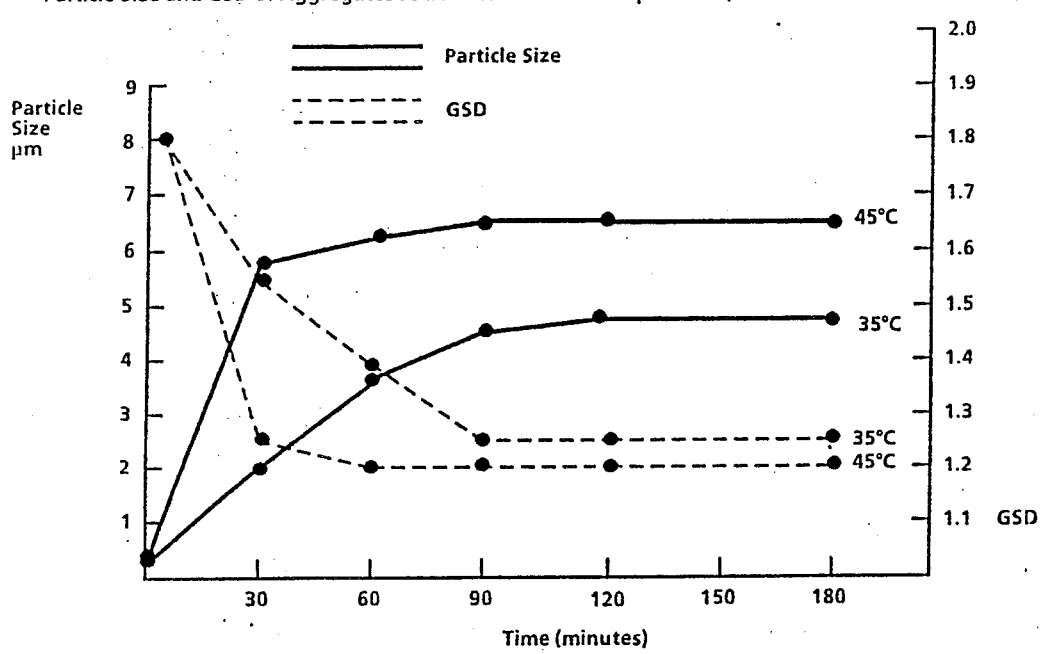

Graph 1 illustrates the effect of temperature on the aggregation process, wherein the X axis is the time in minutes, the y axis on the left is the particle size of the aggregates in microns as measured on the Coulter Counter, and the right side on the y axis illustrates the GSD (particle size distribution) as measured on the Coulter Counter.

From Graph 1, (1) the aggregation process is much faster at 45° C. compared to 35° C. as indicated by the slope of the line; the curve levels off much faster at 45° C. compared to 35° C. (80 minutes compared to 120 minutes); (2) the size of aggregated particles are larger at 45° C. than at 35° C. (6.8 vs 4.8 microns); and (3) an excellent GSD (1.25 or lower) is achieved much faster at 45° C. than 35° C. and is superior (1.21 compared to 1.28). Also, in Graph 1 the molar ratio 1.5:1 refers to the ratio of cationic surfactant SANIZOL B-50 TM to anionic surfactant NEOGEN R TM.

EXAMPLE IV (Styrene/Butadiene/Acrylic Acid)

Aggregation Performed at 35° C.:

Pigment dispersion: 280 grams of dry pigment PV FAST BLUE TM and 58.5 grams of cationic surfactant SANIZOL B-50 TM were dispersed in 8,000 grams of water using a microfluidizer.

A polymeric latex was prepared by emulsion polymerization of styrene/butadiene/acrylic acid (86/12/2 parts) in a nonionic/anionic surfactant solution (NEOGEN R TM/IGEPAL CA 897 TM, 3 percent). The resulting latex contained 60 percent of water and 40 percent of solids; the Tg of the latex sample after drying on the freeze dryer was 53.0° C; $M_w$=46,600, $M_n$=8,0000. The zeta-potential was −85 millivolts.

Preparation of the aggregated particles: 417 grams of the above PV FAST BLUE TM dispersion were added simultaneously with 650 grams of the above prepared latex into the SD41 continuous stirring device containing 600 milliliters of water with 2.9 grams of cationic surfactant SANIZOL B-50 TM. The pigment dispersion and the latex were well mixed by continuous pumping through the rotor stator operating at 10,000 RPM for 8 minutes. This blend ,was than transferred into a kettle that was placed in a heating mantle and equipped with mechanical stirrer and temperature probe. The aggregation was performed at 35° C. for a different number of hours (see Table 3 below). Aggregates with the particle size of 3.5 (at 35° C.) were obtained. After aggregation, 35 milliliters of 10 percent anionic surfactant (NEOGEN R TM) were added and the temperature was raised from about 35° C. to about 80° C. The aggregates were coalesced at 80° C. for 3 hours into a toner by repeating the coalescence step of Example III.

EXAMPLE V

Aggregation Performed at 45° C.

Pigment dispersion: 280 grams of dry pigment PV FAST BLUE TM and 58.5 grams of cationic surfactant SANIZOL B-50 TM were dispersed in 8,000 grams of water using a microfluidizer.

A polymeric latex was prepared by emulsion polymerization of styrene/butadiene/acrylic acid (86/12/2 parts) in a nonionic/anionic surfactant solution (NEOGEN R TM/IGEPAL CA 897 TM, 3 percent). The resulting latex contained 60 percent of water and 40 percent of solids; the Tg of the latex sample after drying on the freeze dryer was 53.0° C.; $M_w$=46,600, $M_n$=8,000. The zeta-potential was −85 millivolts.

Preparation of the aggregated particles: 417 grams of the above PV FAST BLUE TM dispersion were added simultaneously with 650 grams of the above latex into the SD41 continuous stirring device containing 600 milliliters of water with 2.9 grams of cationic surfactant SANIZOL B-50 TM. The pigment dispersion and the latex were well mixed by continuous pumping through the rotor stator operating at 10,000 rpm for 8 minutes. This blend was then transferred into a kettle, placed in the heating mantle and equipped with mechanical stirrer and temperature probe. The aggregation was performed at 45° C. for a different number of hours (see Table 3 below). Aggregates with a particle size of about 4.5 (at 45° C.) were obtained. After aggregation, 35 milliliters of 10 percent anionic surfactant (NEOGEN R TM) were added and the temperature was increased from about 45° C. to about 80° C. Aggregates of polymeric resin and pigment were coalesced into a final toner at 80° C. for 3 hours.

Coalescence of aggregated particles: after aggregation, 35 milliliters of 10 percent anionic surfactant (NEOGEN R TM) were added and the temperature in the kettle was raised from about 45° C. to about 80° C. Aggregates of polymeric resin and pigment were coalesced into toner at 80° C. for 3 hours in accordance with the process of Example III. No change in the particle size and the GSD was observed, compared to the size of the aggregates. The resulting particles were filtered, washed using hot deionized water and dried on the freeze dryer. The resulting cyan toner, about 4.5 microns in average diameter, was comprised of 95 percent resin of poly(styrene-co-butylacrylate-co-acrylic acid), and 5 percent of PV FAST BLUE TM pigment.

TABLE 3

Temperature Effect on Particle Size and GSD in Aggregation Process

| TIME OF AGGREGATION | TEMPERATURE OF AGGREGATION 35° C. EXAMPLE IV | | TEMPERATURE OF AGGREGATION 45° C. EXAMPLE V | |
|---|---|---|---|---|
| | Part. Size | GSD | Part. Size | GSD |
| Agg/1 hour | 2.5 | 1.61 | 4.3 | 1.25 |
| Agg/2 hours | 2.1 | 1.41 | 4.4 | 1.24 |
| Agg/3 hours | 3.3 | 1.32 | 4.5 | 1.26 |
| Agg/20 hours | 3.4 | 1.26 | — | — |
| Heat/3 hrs./80° C. | 3.4 | 1.29 | 4.5 | 1.26 |

Conditions and parameters remained constant: Cationic surfactant (SANIZOL B-50 TM, 1:1 ratio).

Latex: (141 nanometers, −80 millivolts), containing styrene/butadiene/acrylic acid (86/12/2 in parts).

Pigment: PV FAST BLUE TM (dry dispersed in SANIZOL B-50 TM /water in microfluidizer).

Table 3 illustrates the effect of temperature on the aggregation process for styrene/butadiene/acrylic acid latex with PV FAST BLUE TM pigment to form cyan toner. At 45° C., the particle size is also particle size obtained at 35° C. The particle size distribution (GSD) is also superior at 45° C. compared to 35° C. (1.26 as opposed to 1.32 at 3 hours).

Other modifications of the present invention may occur to those skilled in the art subsequent to a review of the present application and these modifications, including equivalents thereof, are intended to be included within the scope of the present invention.

What is claimed is:

1. A process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin, to form electrostatically bound toner size aggregates with a narrow particle size distribution; and (iv) heating said bound aggregates above about the Tg of the resin.

2. A process in accordance with claim I wherein the temperature below the resin Tg of (iii) controls the size of the aggregated particles in the range of from about 2.5 to about 10 microns in average volume diameter.

3. A process in accordance with claim I wherein the size of said aggregates can be increased to from about 2.5 to about 10 microns by increasing the temperature of heating in (iii) to from about room temperature to about 50° C.

4. A process in accordance with claim 1 wherein the aggregation (iii) is a kinetically controlled process.

5. A process in accordance with claim 1 wherein the aggregation of smaller particles to form the toner size aggregates is about 10 times faster when the temperature is increased to from about room temperature to about 50° C., and wherein said temperature is below the resin Tg.

6. A process in accordance with claim 1 wherein the particle size distribution of the aggregated particles is narrower, about 1.40 decreasing to about 1.16, when the temperature is increased from room temperature to 50° C., and wherein said temperature is below the resin Tg.

7. A process in accordance with claim 1 wherein the number of fines of unaggregated submicron particles present is smaller, from more than about 20 percent to less than about 2 percent, when the temperature is increased from room temperature to 50° C., and wherein said temperature is below the resin Tg.

8. A process in accordance with claim 1 wherein the temperature of the aggregation (iii) controls the speed at which particles submicron in size are collected to form toner size aggregates.

9. A process in accordance with claim 1 wherein the surfactant utilized in preparing the pigment dispersion is a cationic surfactant, and the counterionic surfactant present in the latex mixture is an anionic surfactant.

10. A process in accordance with claim 1 wherein the surfactant utilized in preparing the pigment dispersion is an anionic surfactant, and the counterionic surfactant present in the latex mixture is a cationic surfactant.

11. A process in accordance with claim 1 wherein the dispersion of (i) is accomplished by homogenizing at from about 1,000 revolutions per minute to about 10,000 revolutions per minute, at a temperature of from about 25° C. to about 35° C., and for a duration of from about 1 minute to about 120 minutes.

12. A process in accordance with claim 1 wherein the dispersion of (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

13. A process in accordance with claim 1 wherein the dispersion of (i) is accomplished by microfluidization in a microfluidizer or in nanojet for a duration of from about I minute to about 120 minutes.

14. A process in accordance with claim 1 wherein the shearing or homogenization (ii) is accomplished by homogenizing at from about 1,000 revolutions per minute to about 10,000 revolutions per minute for a duration of from about I minute to about 120 minutes.

15. A process in accordance with claim 1 wherein the heating of the blend of latex, pigment, surfactants and optional charge control agent in (iii) is accomplished at temperatures of from about 20° C. to about 5° C. below the Tg of the resin for a duration of from about 0.5 hour to about 6 hours.

16. A process in accordance with claim 1 wherein the heating of the statically bound aggregate particles to form toner size composite particles comprised of pigment, resin and optional charge control agent is accomplished at a temperature of from about 10° C. above the Tg of the resin to about 95° C. for a duration of from about 1 hour to about 8 hours.

17. A process in accordance with claim 1 wherein the resin is selected from the group consisting of poly(styrene-butadiene), poly(paramethyl styrene-butadiene), poly(meta-methylstyrene-butadiene), poly(alpha-methylstyrene-butadiene), poly(methylmethacrylatebutadiene), poly(ethylmethacrylate-butadiene), poly(propylmethacrylatebutadiene), poly(butylmethacrylate-butadiene), poly(methylacrylatebutadiene), poly(ethylacrylate-butadiene), poly(propylacrylate-butadiene), poly(butylacrylate-butadiene), poly(styrene-isoprene), poly(para-methyl styrene-isoprene), poly(meta-methylstyrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

18. A process in accordance with claim 1 wherein the resin is selected from the group consisting of poly(styrene-butadiene-acrylic acid) poly(styrene-butadiene-methacrylic acid) poly(styrene-butylmethacrylateacrylic acid), or poly(styrene-butylacrylate-acrylic acid), polyethyleneterephthalate, polypropylene-terephthalate, polybutylene-terephthalate, polypentylene-terephthalate, polyhexalene-terephthalate, polyheptadeneterephthalate, polystyrene-butadiene, and polyoctalene-terephthalate.

19. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

20. A process in accordance with claim 1 wherein the anionic surfactant is selected from the group consisting of sodium dodecyl sulfate, sodium dodecylbenzene sulfate and sodium dodecylnaphthalene sulfate.

21. A process in accordance with claim 2 wherein the cationic surfactant is a quaternary ammonium salt.

22. A process in accordance with claim 1 wherein the pigment is carbon black, magnetite, cyan, yellow, magenta, and mixtures thereof.

23. A process in accordance with claim 1 wherein the resin utilized in (ii) is from about 0.01 to about 3 microns in average volume diameter; and the pigment particles are from about 0.01 to about 3 microns in volume average diameter.

24. A process in accordance with claim 1 wherein the toner particles isolated are from about 2 to about 15 microns in average volume diameter, and the geometric size distribution thereof is from about 1.15 to about 1.35.

25. A process in accordance with claim 1 wherein the aggregates formed in (iv) are about 1 to about 10 microns in average volume diameter.

26. A process in accordance with claim 1 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, pigment and charge agent.

27. A process in accordance with claim 1 wherein there is added to the surface of the formed toner metal salts, metal salts of fatty acids, silicas, metal oxides, or mixtures thereof, in an amount of from about 0.1 to about 10 weight percent of the obtained toner particles.

28. A process in accordance with claim 1 wherein the toner is washed with warm water and the surfactants are removed from the toner surface, followed by drying.

29. A process in accordance with claim 1 wherein the toner particles isolated are from about 3 to 15 microns in average volume diameter, and the geometric size distribution thereof is from about 1.15 to about 1.30.

30. A process in accordance with claim 1 wherein the electrostatically bound aggregate particles formed in (iii) are from about 1 to about 10 microns in average volume diameter.

31. A process in accordance with claim 2 wherein the nonionic surfactant concentration is about 0.1 to about 5 weight percent of the toner components; and wherein the anionic surfactant concentration is about 0.1 to about 5 weight percent of the toner components.

32. A process in accordance with claim 2 wherein the toner is washed with warm water and the surfactants are removed from the toner surface, followed by drying.

33. A toner obtained by the process of claim 1 and comprised of resin particles, pigment and charge control agent.

34. A developer composition comprised of the toner of claim 33 and carrier particles.

35. A process in accordance with claim 1 wherein said resin of (ii) is submicron in average volume diameter, the sheared blend of (iii) is continuously stirred, and subsequent to (iv) said toner is separated by filtration and subjected to drying.

36. A process for the preparation of toner compositions with controlled particle size comprising:

(i) preparing a pigment dispersion in water, which dispersion is comprised of a pigment of a diameter of from about 0.01 to about 1 micron, and an ionic surfactant;

(ii) shearing the pigment dispersion with a latex blend comprised of resin of submicron size of from about 0.01 to about 1 micron, a counterionic surfactant with a charge polarity of opposite sign to that of said ionic surfactant and a nonionic surfactant thereby causing a flocculation or heterocoagulation of the formed particles of pigment, and resin to form a uniform dispersion of solids in the water and surfactant;

(iii) heating the above sheared blend at a temperature of from about 5° to about 20° C. below the Tg of the resin to form electrostatically bound toner size aggregates with a narrow particle size distribution;

(iv) heating the statically bound aggregated particles at a temperature of from about 5 to about 50° C. above the Tg of the resin to provide a mechanically stable toner composition comprised of polymeric resin and pigment; and optionally (v) separating said toner particles; and (vi) drying said toner particles.

37. A process for the preparation of toner compositions comprising:

(i) preparing a pigment dispersion in water, which dispersion is comprised of a pigment and an ionic surfactant;

(ii) shearing the pigment dispersion with a latex blend comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the water and surfactant;

(iii) heating the above sheared blend below about or about equal to the glass transition temperature (Tg) of the resin to form electrostatically bound toner size aggregates with a narrow particle size distribution;

(iv) heating the statically bound aggregated particles above about or about equal to the Tg of the resin particles to provide a toner composition comprised of resin; followed by optionally (v) separating said toner particles from said water by filtration; and (vi) drying said toner particles.

38. A process in accordance with claim 1 wherein heating in (iii) is from about 5° C. to about 25° C. below the Tg.

39. A process in accordance with claim 1 wherein heating in (iii) is accomplished at a temperature of from about 29° to about 59° C.

40. A process in accordance with claim 1 wherein the resin Tg in (iii) is from about 50° to about 80° C.

41. A process in accordance with claim 1 wherein heating in (iv) is from about 5° to about 50° C. above the Tg.

42. A process in accordance with claim 1 wherein the resin Tg in (iv) is from about 50° to about 80° C.

43. A process in accordance with claim 1 wherein the resin Tg is 54° C. and heating in (iv) is from about 59° to about 104° C.

44. A process in accordance with claim 1 wherein the resin Tg in (iii) is from about 52° to about 65° C.; and the resin Tg in (iv) is from about 52° to about 65° C.

45. A process in accordance with claim 36 wherein the heating in (iii) is equal to or slightly above the resin Tg.

46. A process in accordance with claim 36 wherein the heating in (iv) is equal to or slightly above the resin Tg.

47. A process in accordance with claim 37 wherein the heating in (iii) is equal to or slightly above the resin Tg.

48. A process in accordance with claim 37 wherein the heating in (iv) is equal to or slightly above the resin Tg.

* * * * *